US010494582B2

(12) United States Patent
Hutchison

(10) Patent No.: US 10,494,582 B2
(45) Date of Patent: Dec. 3, 2019

(54) COMPOSITION FOR USE IN OILS

(71) Applicant: PHILLIPS 66 COMPANY, Houston, TX (US)

(72) Inventor: Gregory Scott Hutchison, Broken Arrow, OK (US)

(73) Assignee: Phillips 66 Company, Houston, TX (US)

( * ) Notice: Subject to any disclaimer, the term of this patent is extended or adjusted under 35 U.S.C. 154(b) by 118 days.

(21) Appl. No.: 15/862,802

(22) Filed: Jan. 5, 2018

(65) Prior Publication Data

US 2018/0127677 A1 May 10, 2018

Related U.S. Application Data

(63) Continuation-in-part of application No. 15/251,787, filed on Aug. 30, 2016, now Pat. No. 9,895,631.

(51) Int. Cl.

| | |
|---|---|
| ***B01D 19/04*** | (2006.01) |
| ***C10M 145/10*** | (2006.01) |
| ***C10M 105/06*** | (2006.01) |
| ***C10M 101/02*** | (2006.01) |
| ***C10M 169/04*** | (2006.01) |
| ***C10M 157/00*** | (2006.01) |
| ***C10M 157/10*** | (2006.01) |
| ***C10M 161/00*** | (2006.01) |

(52) U.S. Cl.

CPC ..... *C10M 145/10* (2013.01); *C10M 101/02* (2013.01); *C10M 105/06* (2013.01); *C10M 157/00* (2013.01); *C10M 157/10* (2013.01); *C10M 161/00* (2013.01); *C10M 169/041* (2013.01); *C10M 2203/065* (2013.01); *C10M 2203/10* (2013.01); *C10M 2203/102* (2013.01); *C10M 2203/1006* (2013.01); *C10M 2203/106* (2013.01); *C10M 2203/1025* (2013.01); *C10M 2203/1065* (2013.01); *C10M 2205/028* (2013.01); *C10M 2205/0285* (2013.01); *C10M 2205/22* (2013.01); *C10M 2205/223* (2013.01); *C10M 2207/2805* (2013.01); *C10M 2209/084* (2013.01); *C10M 2209/1033* (2013.01); *C10M 2229/02* (2013.01); *C10M 2229/048* (2013.01); *C10M 2229/051* (2013.01); *C10N 2220/082* (2013.01); *C10N 2230/18* (2013.01); *C10N 2270/02* (2013.01)

(58) Field of Classification Search

None

See application file for complete search history.

(56) References Cited

U.S. PATENT DOCUMENTS

| | | | | |
|---|---|---|---|---|
| 4,115,343 A * | 9/1978 | Guillaume | ..... | C10M 171/004 508/214 |
| 5,712,343 A * | 1/1998 | Geck | ..... | A61K 8/068 524/837 |
| 2017/0121629 A1* | 5/2017 | Xu | ..... | C10M 161/00 |

* cited by examiner

*Primary Examiner* — Vu A Nguyen

(74) *Attorney, Agent, or Firm* — Phillips 66 Company

(57) ABSTRACT

A composition comprising a sheared antifoam solution/mixture with a mean particle size from about 0.01 microns to about 0.5 microns and a maximum particle size of less than about 1 micron. In this composition the sheared antifoam solution/mixture comprises antifoam solution/mixture comprising an antifoam and a base stock.

1 Claim, 1 Drawing Sheet

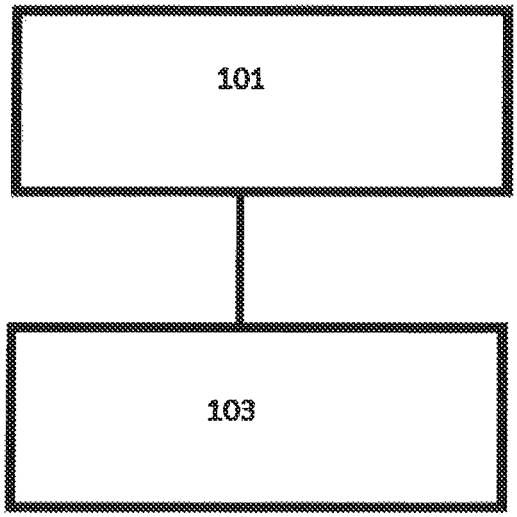
101
103

COMPOSITION FOR USE IN OILS

CROSS-REFERENCE TO RELATED APPLICATIONS

This present invention is a continuation-in-part of U.S. application Ser. No. 15/251,787 filed Aug. 30, 2016 entitled "Composition for Use in Oils", which is hereby incorporated herein by reference in its entirety.

STATEMENT REGARDING FEDERALLY SPONSORED RESEARCH OR DEVELOPMENT

None.

FIELD OF THE INVENTION

This invention relates to a composition for use in oils.

BACKGROUND OF THE INVENTION

An antifoam agent is typically added to oils to reduce foaming and air entrainment. Antifoams are common additives in many types of lubricating oils and hydraulic fluids. The purpose of the antifoam is to retard the formation of stable foam on the surface of the oil in the sump, gearbox, or reservoir. Silicones, or compounds containing silicone, and acrylic copolymers are popularly used in mineral-based lubricant formulations. Lighter grade turbine oils and hydraulic fluids are generally formulated with acrylate antifoam additives while heavier gear oils, paper machine oils, and crankcase lubricants may use silicone.

For the antifoam agents to be effective they need to have limited solubility in the lubricant in which they are added. As lubricating base stocks have become more highly refined the solubility has decreased to a point where it has been increasingly difficult to hold antifoams in suspension without the addition of a solubilizing agent.

There exists a need to increase the effectiveness of antifoam agents.

BRIEF SUMMARY OF THE DISCLOSURE

A composition comprising a sheared antifoam solution/mixture with a mean particle size from about 0.01 microns to about 0.5 microns and a maximum particle size of less than about 1 micron. In this composition the sheared antifoam solution/mixture comprises antifoam solution/mixture comprising an antifoam and a base stock.

In an alternate embodiment, the composition can also comprise an antifoam solution/mixture with a mean particle size from about 0.01 microns to about 0.025 microns and a maximum particle size of less than about 0.5 micron. In this embodiment the sheared antifoam solution/mixture is produced from: forming an antifoam solution/mixture comprising from about 40 wt % to about 60 wt % antifoam and from about 40 wt % to about 60 wt % alkylated naphthalene base stock; and shearing the antifoam solution/mixture with a shear device to produce a sheared antifoam solution/mixture. In this embodiment, the shear device can comprise a shear mixer within a shear screen wherein the shear screen has a plurality of openings displaced throughout and the openings have at least four straight edges.

BRIEF DESCRIPTION OF THE DRAWINGS

A more complete understanding of the present invention and benefits thereof may be acquired by referring to the follow description taken in conjunction with the accompanying drawings in which:

FIG. 1 depicts an embodiment of the present invention.

DETAILED DESCRIPTION

Turning now to the detailed description of the preferred arrangement or arrangements of the present invention, it should be understood that the inventive features and concepts may be manifested in other arrangements and that the scope of the invention is not limited to the embodiments described or illustrated. The scope of the invention is intended only to be limited by the scope of the claims that follow.

As shown in FIG. 1, the method comprises 101 forming an antifoam solution/mixture comprising an antifoam and a base stock. It is then followed by 103 shearing the antifoam solution/mixture with a shear device to produce a sheared antifoam solution/mixture. In this embodiment the sheared antifoam solution/mixture has a maximum particle size of less than about 1 micron.

The method can also be used to create a composition comprising a sheared antifoam solution/mixture with a mean particle size from about 0.01 microns to about 0.5 microns and a maximum particle size of less than about 1 micron. In this composition the sheared antifoam solution/mixture comprises antifoam solution/mixture comprising an antifoam and a base stock.

In one embodiment the antifoam can be any conventionally known antifoam used to reduce foam in lubricating oils. Non-limiting examples of antifoams that can be used include: organo-modified siloxane, silicone, flurosilicone, polyacrylateor combinations thereof.

The amount of antifoam used in the antifoam solution/mixture can vary. In one embodiment the amount of antifoam can range from about 1 wt % to about 99 wt %. In other embodiments the range of antifoam can be from about 10 wt % to about 90 wt %, about 20 wt % to about 80 wt %, about 30 wt % to about 70 wt %, about 40 wt % to about 60 wt %, about 45 wt % to about 55 wt % or even from about 48 wt % to about 53 wt %.

In one embodiment the base stock can be any conventionally known base stock. Non-limiting examples of base stocks that can be used include: esters, polyalkylene glycols, alkylated naphthalenes, polyalphaolefins, kerosene, petroleum mineral oils based on aromatic, naphthenic or paraffinic crude oils or combinations thereof.

The amount of base stock used in the antifoam solution/mixture can vary. In one embodiment the amount of base stock can range from about 1 wt % to about 99 wt %. In other embodiments the range of base stock can be from about 10 wt % to about 90 wt %, about 20 wt % to about 80 wt %, about 30 wt % to about 70 wt %, about 40 wt % to about 60 wt %, about 45 wt % to about 55 wt % or even from about 48 wt % to about 53 wt %.

In one embodiment it is possible that the antifoam solution/mixture only contains antifoam and base stock. In these examples it is possible that the antifoam solution/mixture does not contain a solubilizing agent. Embodiments of the antifoam solution/mixture can either: consist of, consist essentially of or comprise of antifoam and base stock. Non-limiting examples of additional components that could be added to the antifoam solution/mixture include anti-wear additives, extreme pressure additives, detergents, dispersants, demulsifiers, friction modifiers, anti-oxidants, rust inhibitors, corrosion inhibitors or even pour point depressants . . . .

After preparing the antifoam solution/mixture the antifoam solution/mixture can then be sheared with a shear device to produce a sheared antifoam solution/mixture. The shear device can consist of, consist essentially of or comprise of a shear mixer within a shear screen.

The shearing for the antifoam solution/mixture can be performed in a flow system or a batch system.

The shear mixer used as part of the shear device can be any conventionally known shear mixer. In one embodiment the shear mixer is a high-shear mixer that disperses, or transports the antifoam into the base stock. Shear mixers or high-shear mixers typically have a rotor or impeller connected to a blade, together with a stationary component and situated either in a tank containing the antifoam solution/mixture to be mixed or in a pipe through which the antifoam solution/mixture passes. In other embodiments the shear mixer can also be envisioned to be an eppenbach homomixer, a colloid mill, a gaulin homogenizer, or a cowles high shear mixer blade.

Outside the shear device a shear screen can be used to increase shear within the antifoam solution/mixture. The shear screen can be of any size or shape as long as it is larger than the outer diameter of the rotor blade. The shear screen is typically disposed around the outside of the rotor blade to assist in the shearing of the antifoam solution/mixture.

The speed of the rotor blade can range from about 500 to about 30,000 rpm. The selection of the rotor blade speed can be adjusted to achieve maximum sheer effect on the antifoam solution/mixture.

A shear screen is typically circular in shape but in different embodiments different shapes are possible. Examples of different shapes that are possible include oblong, square, star, crescent, or even octagon shaped. The height of the shear screen can be any height feasible to achieve maximum shear effect while balancing the need for flow of the antifoam solution/mixture into the rotor blades.

The multiple perforations around the shear screen aid in the shearing of the antifoam solution/mixture. The perforations can be of any size and shape. In one embodiment the perforations can be circular, triangular, square, rectangular, star shaped or even crescent shaped. In an alternate embodiment the perforations can have at least two straight edges (such as a pizza slice shape), at least three straight edges (such as a triangle or three straight edges and a dome on top), or even at least four straight edges (such as a square).

In one embodiment the multiple perforations are not limited to only one type of perforation and could contain multiple types of perforations.

The sheared antifoam solution/mixture can have a mean particle size from about 0.01 microns to about 0.5 microns, or about 0.01 microns to about 0.25 microns, or about 0.01 microns to about 0.1 microns, or about 0.01 microns to about 0.05 microns, or about 0.01 microns to about 0.025 microns. The maximum particle size of the sheared antifoam solution/mixture can be less than 1.0 microns, less than 0.75 microns, less than 0.5 microns, less than 0.25 microns or even less than 0.1 microns.

It is theorized that the small mean particle size and a small maximum particle size will assist the antifoams to be held in suspension. Further it is theorized the current method and composition will reduce the antifoam effect on particle number determination and reduce the possibility of the antifoams being filtered out of solution/mixture.

The length of time required to achieve the desired particle size can vary from 5 minutes to 24 hours depending on the volume of starting material and the relative mean particle sizes of the starting materials.

The following examples of certain embodiments of the invention are given. Each example is provided by way of explanation of the invention, one of many embodiments of the invention, and the following examples should not be read to limit, or define, the scope of the invention.

The treat rate of this method and composition could vary between 0.001 percent by mass to 99.000 percent by mass. The required treat rate is a function of the final lubricating oil composition, performance requirements and end use application.

In one embodiment the sheared antifoam mixture could be used as part of a finished lubricant or alternatively as part of an additive package. As part of a finished lubricant, the amount of sheared antifoam in the finished lubricant can range from about 0.0025% to about 1.0% of the total finished lubricant or from 0.0025% to about 0.050%, or 0.0025% to about 0.040%, or from about 0.0025% to about 0.020%. The amount of active ppm of the sheared antifoam mixture can be from 5 to 400 ppm, 5 to 200 ppm, 5 to 100 ppm, 5 to 100 ppm, 5 to 80 ppm, 5 to 60 ppm, 5 to 40 ppm or even 5 to 20 ppm.

Example 1

A batch lab scale mixer was used with a duplex mixing assembly with a general purpose disintegrating head. A polyacrylate antifoam was mixed 50:50 with a base stock. The results are shown below:

TABLE 1

| | Base Stock | | | | | |
|---|---|---|---|---|---|---|
| | Alkylated Naphthalene | Alkylated Naphthalene | Paraffinic | Paraffinic | Naphthenic | Naphthenic |
| Mixing Method | Duplex head | Prop | Duplex head | Prop | Duplex head | Prop |
| Minimum Size, Micron | 0.276 | 0.357 | 0.276 | 1.45 | 2.13 | 2.13 |
| Maximum Size, Micron | 14.5 | 1.65 | 5.21 | 8.68 | 24.1 | 12.7 |
| Dn (10) micron | 0.335 | 0.477 | 0.364 | 2.06 | 2.85 | 2.61 |
| Dn (50) micron | 0.464 | 0.650 | 0.545 | 2.97 | 3.90 | 3.50 |
| Dn (90) micron | 0.686 | 0.965 | 1.04 | 4.74 | 5.82 | 5.17 |
| Solution Stability | Stable | Stable | Separates | Separates | Stable | Stable |

Example 2

A batch lab scale mixer was used with a shear screen. The shear screen used for this example did not have any straight edges and had perforations that were circular. A polyacrylate antifoam was mixed 50:50 with an alkylated naphthalene base stock. The results are shown below:

TABLE 2

| | Time (minutes) | | | | |
|---|---|---|---|---|---|
| | 0 | 2 | 5 | 10 | 10 |
| Minimum Size, Micron | 0.675 | 0.357 | 0.357 | 0.01 | 0.01 |
| Maximum Size, Micron | 21.1 | 24.1 | 14.5 | 0.243 | 0.276 |
| Dn (10) micron | 0.993 | 0.493 | 0.405 | 0.0114 | 0.0113 |
| Dn (50) micron | 1.32 | 0.708 | 0.592 | 0.0163 | 0.0161 |
| Dn (90) micron | 1.86 | 1.14 | 0.929 | 0.0322 | 0.0314 |

Example 3

A batch lab scale mixer was used with a shear screen. The shear screen used for this example had perforations with four straight edges. A polyacrylate antifoam was mixed 50:50 with an alkylated naphthalene base stock. The results are shown below:

TABLE 3

| | Time (minutes) | | | | |
|---|---|---|---|---|---|
| | 0 | 2 | 5 | 10 | 10 |
| Minimum Size, Micron | 0.675 | 0.405 | 0.0114 | 0.01 | 0.01 |
| Maximum Size, Micron | 21.1 | 27.4 | 0.594 | 0.276 | 0.243 |
| Dn (10) micron | 0.993 | 0.575 | 0.0138 | 0.0113 | 0.0128 |
| Dn (50) micron | 1.32 | 0.836 | 0.0184 | 0.0164 | 0.0192 |
| Dn (90) micron | 1.86 | 1.35 | 0.0346 | 0.0338 | 0.0402 |

Comparative Examples

The Foam Test measures the foaming tendency of a lubricant. According to this test, also referred to as ASTM D892, the tendency of oils to foam can be a serious problem in systems such as high-speed gearing, high-volume pumping, and splash lubrication. Inadequate lubrication, cavitation, and overflow loss of lubricant can lead to mechanical failure. This test evaluates oils for such operating conditions.

A fluid's foaming property is measured using ASTM D892, which measures foam by three sequences that differ only in testing temperature.

Sequence I measures the foaming tendency and stability at 24° C. (75° F.).

Sequence II uses 93.5° C. (200° F.).

Sequence III uses the same conditions as Sequence I, except it's performed on fluid that has just been measured in Sequence II.

The fluid sample from Sequence I isn't used in Sequence II. The fluid sample used in Sequence II is carried into Sequence III. The results are reported as two numbers for each sequence. For example: 20/0 means 20 milliliters of foam tendency was measured followed by no foam stability (0 ml) after a settling time.

TABLE 4

| ISO 32 Lubricant with Additive Package A with Sheared Antifoam | | | | | | |
|---|---|---|---|---|---|---|
| | 1 | 2 | 3 | 4 | 5 | 6 |
| Base Oil, ISO 32 | 99.00 | 98.9975 | 98.995 | 98.99 | 98.98 | 98.96 |
| Additive Package A | 0.85 | 0.85 | 0.85 | 0.85 | 0.85 | 0.85 |
| Pour Point Depressant | 0.15 | 0.15 | 0.15 | 0.15 | 0.15 | 0.15 |
| Sheared Antifoam | 0 | 0.0025 | 0.005 | 0.010 | 0.020 | 0.040 |
| Shear Antifoam, ppm Active | 0 | 5 | 10 | 20 | 40 | 80 |
| Sequence I Foam, (Tendency/Stability), mL | 310-0 | 170-0 | 10-0 | 10-0 | 0-0 | 0-0 |
| Sequence II Foam, (Tendency/Stability), mL | 0-0 | 0-0 | 0-0 | 0-0 | 0-0 | 0-0 |
| Sequence III Foam, (Tendency/Stability), mL | 210-0 | 0-0 | 0-0 | 0-0 | 0-0 | 0-0 |

TABLE 5

| ISO 32 Lubricant with Additive Package A with Un-Sheared Antifoam | | | | | | |
|---|---|---|---|---|---|---|
| | 7 | 8 | 9 | 10 | 11 | 12 |
| Base Oil, ISO 32 | 99.00 | 98.9975 | 98.995 | 98.99 | 98.98 | 98.96 |
| Additive Package A | 0.85 | 0.85 | 0.85 | 0.85 | 0.85 | 0.85 |
| Pour Point Depressant | 0.15 | 0.15 | 0.15 | 0.15 | 0.15 | 0.15 |
| Un-Sheared Antifoam | 0 | 0.0025 | 0.005 | 0.010 | 0.020 | 0.040 |
| Antifoam, ppm Active | 0 | 10 | 20 | 40 | 80 | 160 |
| Sequence I Foam, (Tendency/Stability), mL | 310-0 | 70-0 | 80-0 | 110-0 | 110-0 | 140-0 |
| Sequence II Foam, (Tendency/Stability), mL | 0-0 | 0-0 | 0-0 | 0-0 | 0-0 | 0-0 |
| Sequence III Foam, (Tendency/Stability), mL | 210-0 | 0-0 | 0-0 | 0-0 | 0-0 | 0-0 |

TABLE 6

| ISO 68 Lubricant with Additive Package A with Sheared Antifoam | | | | | | |
|---|---|---|---|---|---|---|
| | 13 | 14 | 15 | 16 | 17 | 18 |
| Base Oil, ISO 68 | 99.00 | 98.9975 | 98.995 | 98.99 | 98.98 | 98.96 |
| Additive Package A | 0.85 | 0.85 | 0.85 | 0.85 | 0.85 | 0.85 |
| Pour Point Depressant | 0.15 | 0.15 | 0.15 | 0.15 | 0.15 | 0.15 |
| Sheared Antifoam | 0 | 0.0025 | 0.005 | 0.010 | 0.020 | 0.040 |
| Shear Antifoam, ppm Active | 0 | 5 | 10 | 20 | 40 | 80 |
| Sequence I Foam, (Tendency/Stability), mL | 230-0 | 440-0 | 330-0 | 180-0 | 20-0 | 0-0 |
| Sequence II Foam, (Tendency/Stability), mL | 0-0 | 20-0 | 20-0 | 20-0 | 30-0 | 30-0 |
| Sequence III Foam, (Tendency/Stability), mL | 50-0 | 290-0 | 0-0 | 0-0 | 0-0 | 0-0 |

TABLE 7

ISO 68 Lubricant with Additive Package A with Un-Sheared Antifoam

| | 19 | 20 | 21 | 22 | 23 | 24 |
|---|---|---|---|---|---|---|
| Base Oil, ISO 68 | 99.00 | 98.9975 | 98.995 | 98.99 | 98.98 | 98.96 |
| Additive Package A | 0.85 | 0.85 | 0.85 | 0.85 | 0.85 | 0.85 |
| Pour Point Depressant | 0.15 | 0.15 | 0.15 | 0.15 | 0.15 | 0.15 |
| Un-Sheared Antifoam | 0 | 0.0025 | 0.005 | 0.010 | 0.020 | 0.040 |
| Antifoam, ppm Active | 0 | 10 | 20 | 40 | 80 | 160 |
| Sequence I Foam, (Tendency/Stability), mL | 230-0 | 170-0 | 150-0 | 140-0 | 50-0 | 30-0 |
| Sequence II Foam, (Tendency/Stability), mL | 0-0 | 0-0 | 0-0 | 0-0 | 0-0 | 0-0 |
| Sequence III Foam, (Tendency/Stability), mL | 50-0 | 0-0 | 0-0 | 0-0 | 0-0 | 0-0 |

TABLE 8

ISO 32 Lubricant with Additive Package B with Sheared Antifoam

| | 25 | 26 | 27 | 28 | 29 | 30 |
|---|---|---|---|---|---|---|
| Base Oil, ISO 32 | 99.20 | 99.1975 | 99.195 | 99.19 | 99.18 | 99.16 |
| Additive Package B | 0.60 | 0.60 | 0.60 | 0.60 | 0.60 | 0.60 |
| Pour Point Depressant | 0.20 | 0.20 | 0.20 | 0.20 | 0.20 | 0.20 |
| Sheared Antifoam | 0 | 0.0025 | 0.005 | 0.010 | 0.020 | 0.040 |
| Shear Antifoam, ppm Active | 0 | 5 | 10 | 20 | 40 | 80 |
| Sequence I Foam, (Tendency/Stability), mL | 220-0 | 70-0 | 100-0 | 0-0 | 0-0 | 0-0 |
| Sequence II Foam, (Tendency/Stability), mL | 0-0 | 0-0 | 0-0 | 0-0 | 0-0 | 0-0 |
| Sequence III Foam, (Tendency/Stability), mL | 200-0 | 0-0 | 0-0 | 0-0 | 0-0 | 0-0 |

TABLE 9

ISO 32 Lubricant with Additive Package B with Un-Sheared Antifoam

| | 31 | 32 | 33 | 34 | 35 | 36 |
|---|---|---|---|---|---|---|
| Base Oil, ISO 32 | 99.20 | 99.1975 | 99.195 | 99.19 | 99.18 | 99.16 |
| Additive Package B | 0.60 | 0.60 | 0.60 | 0.60 | 0.60 | 0.60 |
| Pour Point Depressant | 0.20 | 0.20 | 0.20 | 0.20 | 0.20 | 0.20 |
| Un-Sheared Antifoam | 0 | 0.0025 | 0.005 | 0.010 | 0.020 | 0.040 |
| Antifoam, ppm Active | 0 | 10 | 20 | 40 | 80 | 160 |
| Sequence I Foam, (Tendency/Stability), mL | 220-0 | 0-0 | 0-0 | 0-0 | 0-0 | 0-0 |
| Sequence II Foam, (Tendency/Stability), mL | 0-0 | 50-0 | 50-0 | 40-0 | 40-0 | 20-0 |
| Sequence III Foam, (Tendency/Stability), mL | 200-0 | 0-0 | 0-0 | 0-0 | 0-0 | 0-0 |

TABLE 10

ISO 68 Lubricant with Additive Package B with Sheared Antifoam

| | 37 | 38 | 39 | 40 | 41 | 42 |
|---|---|---|---|---|---|---|
| Base Oil, ISO 68 | 99.20 | 99.1975 | 99.195 | 99.19 | 99.18 | 99.16 |
| Additive Package B | 0.60 | 0.60 | 0.60 | 0.60 | 0.60 | 0.60 |
| Pour Point Depressant | 0.20 | 0.20 | 0.20 | 0.20 | 0.20 | 0.20 |
| Sheared Antifoam | 0 | 0.0025 | 0.005 | 0.010 | 0.020 | 0.040 |
| Shear Antifoam, ppm Active | 0 | 5 | 10 | 20 | 40 | 80 |
| Sequence I Foam, (Tendency/Stability), mL | 440-0 | 180-0 | 50-0 | 0-0 | 0-0 | 0-0 |
| Sequence II Foam, (Tendency/Stability), mL | 10-0 | 10-0 | 10-0 | 10-0 | 10-0 | 20-0 |
| Sequence III Foam, (Tendency/Stability), mL | 320-0 | 20-0 | 0-0 | 0-0 | 0-0 | 0-0 |

TABLE 11

ISO 68 Lubricant with Additive Package B with Un-Sheared Antifoam

| | 43 | 44 | 45 | 46 | 47 | 48 |
|---|---|---|---|---|---|---|
| Base Oil, ISO 68 | 99.20 | 99.1975 | 99.195 | 99.19 | 99.18 | 99.16 |
| Additive Package B | 0.60 | 0.60 | 0.60 | 0.60 | 0.60 | 0.60 |
| Pour Point Depressant | 0.20 | 0.20 | 0.20 | 0.20 | 0.20 | 0.20 |
| Un-Sheared Antifoam | 0 | 0.0025 | 0.005 | 0.010 | 0.020 | 0.040 |
| Antifoam, ppm Active | 0 | 10 | 20 | 40 | 80 | 160 |
| Sequence I Foam, (Tendency/Stability), mL | 440-0 | 20-0 | 0-0 | 0-0 | 0-0 | 0-0 |
| Sequence II Foam, (Tendency/Stability), mL | 10-0 | 20-0 | 30-0 | 40-0 | 40-0 | 30-0 |
| Sequence III Foam, (Tendency/Stability), mL | 320-0 | 0-0 | 0-0 | 0-0 | 0-0 | 0-0 |

In closing, it should be noted that the discussion of any reference is not an admission that it is prior art to the present invention, especially any reference that may have a publication date after the priority date of this application. At the same time, each and every claim below is hereby incorporated into this detailed description or specification as an additional embodiment of the present invention.

Although the systems and processes described herein have been described in detail, it should be understood that various changes, substitutions, and alterations can be made without departing from the spirit and scope of the invention as defined by the following claims. Those skilled in the art may be able to study the preferred embodiments and identify other ways to practice the invention that are not exactly as described herein. It is the intent of the inventors that variations and equivalents of the invention are within the scope of the claims while the description, abstract and drawings are not to be used to limit the scope of the invention. The invention is specifically intended to be as broad as the claims below and their equivalents.

The invention claimed is:

1. A composition comprising:

an antifoam mixture with a mean particle size from about 0.01 microns to about 0.025 microns and a maximum particle size of less than about 0.5 micron wherein the sheared antifoam mixture is produced from:

forming an antifoam mixture comprising from about 40 wt % to about 60 wt % antifoam and from about 40 wt % to about 60 wt % alkylated naphthalene base stock; and shearing the antifoam mixture with a shear device to produce a sheared antifoam mixture, wherein the shear device comprise a shear mixer within a shear screen wherein the shear screen has a plurality of openings displaced throughout and the openings have at least four straight edges.

* * * * *